United States Patent [19]

Ayers

[11] Patent Number: 4,583,602

[45] Date of Patent: Apr. 22, 1986

[54] SHAPED CHARGE PERFORATING DEVICE

[75] Inventor: David B. Ayers, Houston, Tex.

[73] Assignee: Dresser Industries, Inc., Dallas, Tex.

[21] Appl. No.: 500,756

[22] Filed: Jun. 3, 1983

[51] Int. Cl.[4] ..... E21B 43/11

[52] U.S. Cl. ..... 175/4.52; 166/55.1; 175/4.6

[58] Field of Search ..... 175/4.51, 4.52, 4.53, 175/4.54, 4.55, 4.56, 4.57, 4.58, 4.59, 4.6; 166/63, 55.1, 299, 297; 403/104, 357, 329

[56] References Cited

U.S. PATENT DOCUMENTS

| | | | |
|---|---|---|---|
| 2,256,419 | 9/1941 | Tinnerman | 403/357 |
| 2,402,153 | 3/1944 | Elliott | 164/0.05 |
| 2,433,231 | 10/1945 | Martin | 164/0.05 |
| 2,565,788 | 8/1947 | Tow | 164/0.05 |
| 2,649,046 | 8/1953 | Davis | 175/4.6 X |
| 2,680,406 | 3/1949 | Austin | 102/20 |
| 2,742,857 | 4/1956 | Turechek | 102/20 |
| 2,750,885 | 6/1956 | Schlumberger | 175/4.6 |
| 2,764,938 | 10/1956 | Harcus | 102/20 |
| 2,980,017 | 4/1961 | Castel | 102/20 |
| 3,175,617 | 3/1965 | North | 175/4.51 |
| 3,346,056 | 10/1967 | Bohn | 175/4.6 |
| 3,666,030 | 5/1972 | Bohn et al. | 175/4.56 |
| 3,773,119 | 11/1973 | Shore | 175/4.6 |
| 4,194,577 | 3/1980 | Vann | 175/4.51 |
| 4,467,878 | 8/1984 | Ibsen | 175/4.59 |

OTHER PUBLICATIONS

WELEX, "Spiral Jet Perforator", Halliburton Company, Feb. 1981.

*Primary Examiner*—Stephen J. Novosad
*Assistant Examiner*—William P. Neuder
*Attorney, Agent, or Firm*—Patrick H. McCollum; Richard M. Byron

[57] ABSTRACT

An improved small diameter, high density shaped charge perforating apparatus is provided. The perforating apparatus includes an elongated carrier member having a plurality of shaped charge receiving stations spirally located therealong. The anterior and dorsal sections of the shaped charges extend outside the outer diameter of the carrier member and a length of helically wound detonator cord passes through an axial aperture in the dorsal section to retain the shaped charges in the carrier member. An alignment member is connected to one end of the carrier member to prevent rotational movement of the carrier member within the gun body and aligns the axis of perforation for each shaped charge with spotfaces on recesses in the periphery of the gun body.

3 Claims, 4 Drawing Figures

SHAPED CHARGE PERFORATING DEVICE

BACKGROUND OF THE INVENTION

This invention relates to improved apparatus for perforating subsurface earth formations, and more particularly to a high density shaped charge perforating apparatus having a relatively small diameter.

It has become common practice in the completion of oil and gas wells to perforate the well casing and the surrounding formations to bring a well into production. One typical perforating device comprises detonating explosives of high energy and of the general character and form known as "shaped charges." In a typical embodment, a plurality of shaped charges are mounted in a fluid-tight, cylindrical housing or on an elongated bar member which is adapted to traverse a well to be perforated. The shaped charges are mounted in a variety of patterns along the length of the carrier member, with the axis of perforation directed generally laterally therefrom. A plurality of carrier members may be mechanically serially linked together to provide for perforating the casing and surrounding formations over a desired vertical interval.

In perforating subsurface formations it is often desirable to maximize the number of perforations in a given vertical interval of a well. Maximization of the number of perforations requires a high shot density perforating gun. High shot density perforating has significant operating time reduction over conventional perforating operations, thus reducing costs associated with the operation.

Typical high shot density perforating guns employ an array of shaped charges at a plurality of spaced intervals along the longitudinal length of the perforating gun. Each array typically utilizes three or four shaped charges with each array spaced three to four inches apart. While high shot density perforating guns of these designs have proven successful in larger diameter guns they are unsuited for smaller diameter guns.

Small diameter, four inches or less outer diameter, perforating guns are not suited for using an array of shaped charges. To employ such an array requires a significant reduction in the size of the shaped charges, thereby significantly reducing the amount of explosives, resulting in a reduction in the length of the perforation. An additional difficulty in high shot density, small diameter perforating gun is that of charge interference. Charge interference is the disturbance of the order of the undetonated charges by the explosion of a detonated charge. To avoid charge interference the detonator cord must set off a charge before the explosion of a previous charge interferes with the subsequent charge.

These and other disadvantages are overcome with the present invention by providing an apparatus for perforating well casings and the surrounding formations using a relatively small diameter perforating gun having a high shot density.

SUMMARY OF THE INVENTION

In a preferred embodiment of the invention, a perforating device is provided which, in its overall concept, provides for six shaped charges per foot at a phasing of sixty degrees in a outside diameter of four inches or less. The perforating device includes a charge carrier member having a plurality of shaped charge receiving stations located on a right hand spiral with a twelve inch lead spaced two inches between center lines. The shaped charges are secured in the carrier member by a length of detonator cord wrapped about the carrier member in a helical fashion. The detonator cord passes through axial passages in the dorsal section of each shaped charge. A mounting and alignment member connected to one end of the carrier prevents the carrier member from rotational movement in the gun body and causes the axis of perforation for each of the shaped charges to be aligned with spotfaces or recesses in the outer periphery of the gun member.

These and other features and advantages of the present invention will be more readily understood by those skilled in the art from a reading of the following detailed description with reference to the accompanying drawings.

DETAILED DESCRIPTION OF THE PREFERRED EMBODIMENT

Figures 1, 2:
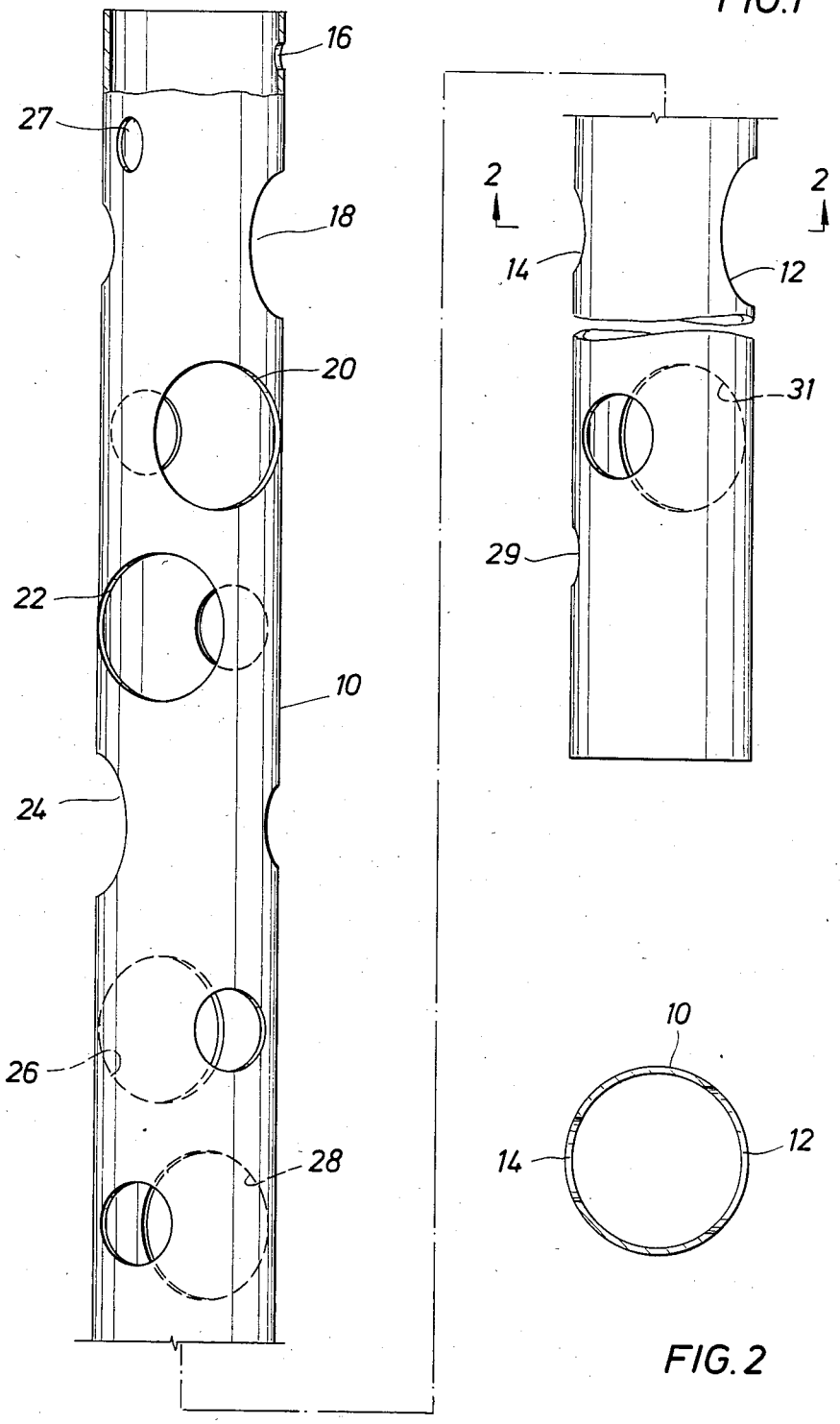
FIG. 1 is a detailed view, partially in cross-section of the shaped charge carrier member of the perforating gun in accordance with the present invention.
FIG. 2 is a cross-sectional view taken along the lines 2—2 of FIG. 1.

Referring now to the drawings in more detail, particularly to FIG. 1, there is illustrated partially in cross-section, shaped charge carrier member 10 utilized in the present perforating apparatus. Carrier member 10 is a tubular carrier member constructed of a length of metal tubing. However, a tubular member constructed of cardboard, phenolic or other suitable material may be used. Carrier member 10 can be of any desired length in accordance with the length of the perforating gun and is sized for insertion within a perforating gun body member, which will be more fully described later herein. In the preferred embodiment carrier member 10 is constructed of an aluminum tubular member having an outside diameter of 1.88 inches and an inside diameter of 1.76 inches.

In order to provide the desired high shot density and to reduce charge interference within a relatively small diameter perforating gun the shaped charges are mounted within carrier member 10 in a generally helical pattern. Referring briefly to FIG. 2 there is illustrated a sectional view of carrier member 10 taken along the lines 2—2 of FIG. 1. As illustrated in FIG. 2, at spaced intervals carrier member 10 has a pair of apertures 12 and 14 having a common centerline and disposed on opposite sides of carrier member 10. Aperture 12, illustrated on the top side of carrier member 10, is preferable 1.531 inches in diameter and aperture 14, located on the bottom side of carrier member 10, is preferable 0.812 inches in diameter. As will be more fully illustrated later herein apertures 12 and 14 are utilized for receiving a shaped charge within carrier member 10.

Returning now to FIG. 1, the left-most illustrated end of carrier member 10 is used as a zero reference point. Through-hole or aperture 16 is provided for attaching an alignment to carrier member 10 and in the preferred embodiment is spaced 0.37 inches from the reference end. A series of shaped charge mounting locations, as shown in FIG. 2, are spaced along carrier member 10 on a right hand spiral with a twelve inch lead spaced two inches between center lines. The first shaped charge mounting location 18 has a centerline spaced 2.23 inches from the reference end with each additional shaped mounting location, illustrated at 20, 22, 24, 26 and 28, having a center line two inches from the preceeding location center line. By providing a twelve inch lead the shaped charges will be phased at sixty degrees providing a shot density of six per foot with six separate explosions per foot. Additionally, two apertures 27 and 29 one aperture located proximate each end of carrier member 10 are provided. Both apertures 27 and 29 are located at a sixty degree phase from the closest shaped charge mounting location, 18 and 31 respectively.

As previously mentioned, carrier member 10 can be of any desired length. To provide eighteen charges per carrier a preferred length of 39.50 inches is used. For thirty-six holes a total length of 75.50 inches is used and for sixty holes a length of 123.50 inches is preferable.

Figure 3:
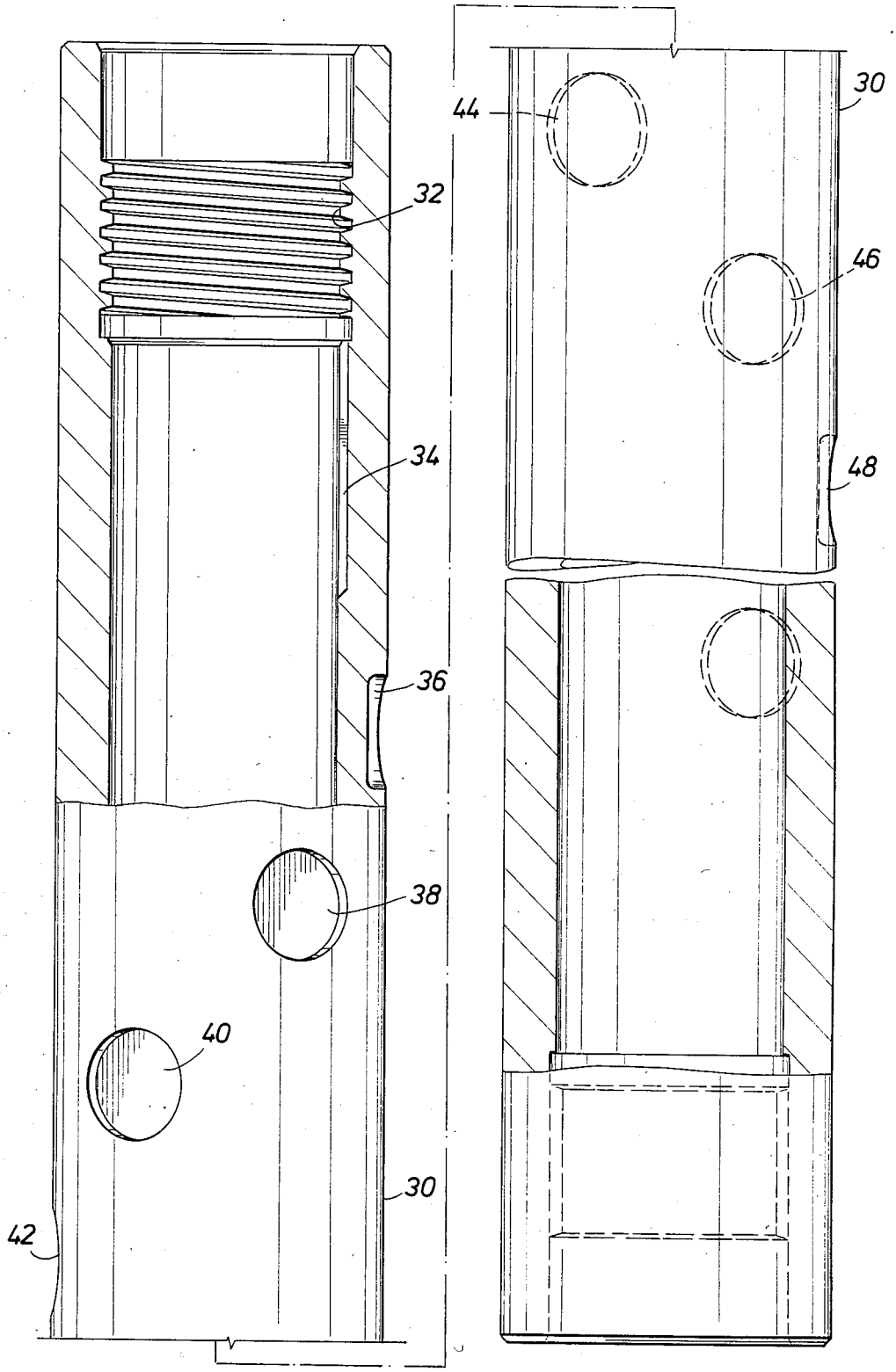
FIG. 3 is a detailed view, partially in cross-section, of the perforating gun body.

Referring now to FIG. 3, there is illustrated, partially in cross-section, perforating gun body 30. Gun body 30 comprises an elongated tubular member constructed of a suitable metal, such as steel. The outside diameter of gun body 30 is preferable less than four inches with an inside diameter of 2.625 inches. The overall length of gun body 30 is sized to provide a desired number of perforations over the gun interval. For example, a four foot body is employed for eighteen shots, a seven foot body for thirty-six shots and an eleven foot body for sixty shots.

For purposes of description the left-most end of illustrated gun body 30 is used as a zero reference point. Gun body 30 is equipped with suitable means for attachment, such as a thread connection illustrated at 32. Elongated slot 34 is milled along the internal portion of gun body 30. In the preferred embodiment slot 34 is 1.50 inches in length and 0.312 inches in width. In line with slot 34 is illustrated a first spotface of "scallop" 36. Scallop 36 consists of a milled recess in gun body 30. Scallop 36 is spaced 7.50 inches from the reference end of gun body 30. Additional scallops, 38, 40, 42, 44, 46 and 48 are located along the length of gun body 30 on a right hand spiral having a twelve inch lead spaced two inches between center lines.

Figure 4:
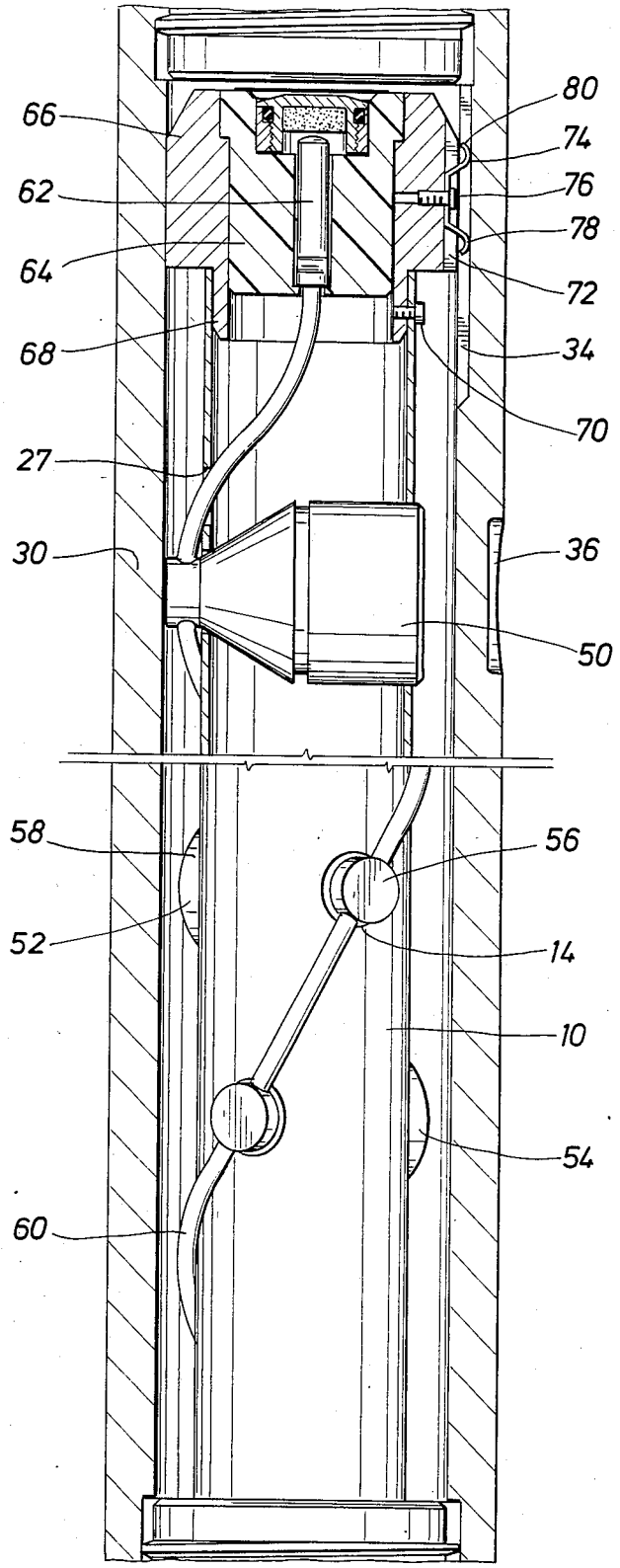
FIG. 4 is a detailed view, partially in cross-section of an assembled perforating gun in accordance with the present invention.

Referring now to FIG. 4 there is illustrated, partially in cross-section, an assembled perforating gun in accordance with the present invention. Inserted longitudinally within tubular gun body 30 is carrier member 10. A plurality of shaped charges, illustrated by 50, 52 and 54, are mounted on carrier member 10. The shaped charges are mounted on carrier member 10 having the dorsal portion 56 of each shaped charge protruding through aperture 14 in carrier member 10 with the anterior portion 58 of each shaped charge protruding through aperture 12 in carrier member 10. The shaped charges 50, 52 and 54 are restrained in carrier member 10 by detonator cord 60. Detonator cord 60 is wound about carrier member 10 in a generally helical pattern passage through axial apertures in the dorsal portion 56 of the shaped charges 50, 52 and 54. Thus the shaped charges are secured in their mounting locations by detonator cord 60 only, thereby eliminating the need for more complex mechanical mounting devices.

Detonator cord 60 is preferably, but not limited to, the type known commercially as R.D.X. plastic covered Primacord. For purpose of illustration, detonator cord 60 passes through aperture 27 and one end of detonator cord 60 terminates at booster 62 of the perforating gun detonator assembly. A more complete description of this detonator assembly can be found by reference to co-pending U.S. patent application Ser. No. 476,448 filed Mar. 17, 1983, which is incorporated herein by reference. Booster 62 is mounted along the centerline of holder member 64 which is mounted within mounting block 66. A reduced diameter end 68 of mounting block 66 is inserted within carrier member 10 and secured in place by suitable means such as threaded screw 70. The larger diameter end of mounting block 66 is sized to be slightly less than the inside diameter of gun body 30 and has longitudinal slot 72 miled therein in line with aperture 16 of carrier member 10 and mounting screw 70. Biasing element 74 is mounted in longitudinal slot 72 by threaded screw 76. Biasing element 74 has two arcute members 78 and 80 which are sized for insertion into and longitudinally slidable in slot 34 in gun body 30 while preventing rotational movement of mounting block 66 and thus of carrier member 10.

Although detonator system described above is one found in tubing conveyed perforating gun it should be recognized that the perforating apparatus of the present invention can likewise be used in a wireline conveyed perforating gun.

In assembling the perforating gun of FIG. 4, carrier member 10 is inserted into gun body 30. Biasing element 74 is aligned with slot 34 and carrier member 10 is fully inserted into gun body 30. When biasing element 74 is so aligned with slot 34 and carrier member 10 is fully inserted into gun body 30 the perforating axes of the spaced charges are aligned with scallops in gun body 30.

Many modifications and variations besides these specifically mentioned may be made in the techniques and structures described herein and depicted in the accompanying drawings without departing substantially from the concept of the present invention. For example, while the specification describes a gun body having scallops on a right hand helix in line with the axes of perforating of the shaped charges it should be recognized that the present invention may be used in conjunction with a perforating gun having no scalloping or having scallops on a left hand helix with the shaped charges affixed to the carrier member on a corresponding left hand helix. Accordingly, it should be clearly understood that the form of the invention described and illustrated herein is exemplary only, and is not intended as a limitation on the scope of the present invention.

The embodiments of the invention in which an exclusive property or privilege is claimed are defined as follows:

1. A shaped charge perforating apparatus, comprising:

an elongated tubular housing member having a plurality of recesses spirally spaced therealong;

an elongated tubular carrier member having a plurality of shaped charge mounting locations spirally spaced therealong;

a plurality of shaped charge units positioned in said mounting locations of said carrier member;

a length of detonator cord helically wound about said tubular carrier member for transferring detonation waves to said shaped charge units and for retaining said shaped charge units within said mounting locations; and means for aligning said tubular carrier within said tubular housing member so as to align said shaped charge units with said spaced recesses along said housing member, said alignment means further comprising an elongated slot in said housing member; and biasing means affixed to said carrier member for engagement within said slot.

2. The shaped charge perforating apparatus of claim 1 wherein said shaped charge mounting locations further comprise a pair of opposed lateral ports located along said carrier member.

3. The shaped charge perforating apparatus of claim 2 further comprising said shaped charge units having an anterior portion extending through one of said ports and a dorsal portion having an axial aperture therethrough said detonator cord extending through said axial aperture for retaining said shaped charge units within said mounting locations.

* * * * *